United States Patent [19]

Byszewski et al.

[11] Patent Number: 4,713,587

[45] Date of Patent: Dec. 15, 1987

[54] MULTIPULSE STARTING AID FOR HIGH-INTENSITY DISCHARGE LAMPS

[75] Inventors: Wojciech W. Byszewski, Concord; Charles N. Fallier, Jr., Westford; James N. Lester, Rockport, all of Mass.

[73] Assignees: GTE Laboratories Incorporated, Waltham, Mass.; GTE Products Corporation, Stamford, Conn.

[21] Appl. No.: 495

[22] Filed: Jan. 5, 1987

[51] Int. Cl.[4] ..... H05B 37/00

[52] U.S. Cl. ..... 315/289; 315/106; 315/276; 315/244

[58] Field of Search ..... 315/276, 244, 289; 315/106, 244, 276, 289

[56] References Cited

U.S. PATENT DOCUMENTS

| | | | |
|---|---|---|---|
| 4,353,012 | 10/1982 | Fallier et al. | 315/289 |
| 4,458,181 | 7/1984 | Johnson | 315/276 |
| 4,496,880 | 1/1985 | Luck | 315/276 |
| 4,609,852 | 9/1986 | Perper | 315/276 |
| 4,629,945 | 12/1986 | Fallier et al. | 315/106 |

*Primary Examiner*—Harold Dixon

*Attorney, Agent, or Firm*—Fred Fisher

[57] ABSTRACT

A multipulse starting aid for a high-intensity discharge lamp includes a spiral line, a bi-directional solid-state switch, or a spark gap, coupled to one of the ends of the spiral line, a resistance in association with the spiral line to provide an RC time constant. The time constant RC is so adjusted that, upon receiving the alternating current voltage from the appropriate source, a waveform of voltage is presented across the pair of terminals of the lamp, together with the series of pulses at the peak of each half cycle of the waveform. thereby enhancing the lamp startability.

10 Claims, 11 Drawing Figures

MULTIPULSE STARTING AID FOR HIGH-INTENSITY DISCHARGE LAMPS

BACKGROUND OF THE INVENTION

1. Field of the Invention

This invention relates to a multipulse starting aid for high intensity discharge lamps. Accordingly, it is a general object of this invention to provide new and improved aids and generators of such character.

2. General Background

U.S. Pat. No. 4,325,004, issured Apr. 13, 1982, "Method and Aapparatus for Starting High Intensity Discharge Lamps", Joseph M. Proud, Leslie A. Riseberg, and Charels N. Fallier, Jr.; U.S. Pat. No. 4,353,012, issued Oct. 5, 1982, "Pulse Injection Starting For High Intensity Discharge Metal Halide Lamps", Charles N. Fallier, Jr. and Joseph M. Proud; and U.S. Pat. No. 4,484,085, issued Nov. 20, 1984, "Spiral Line Voltage Pulse Generator Characterized by Secondary Winding", Charles N. Fallier Jr. and Joseph M. Proud, teach the use of spiral line generators for triggering high-intensity discharge lamps. Spiral line pulse generators are described in U.S. Pat. No. 3,289,015 and in "Novel Principle of Transient High Voltage Generator" by Fitch et al., Proceedings IEEE, Vol 111, No. 4, April (1964).

High-intensity discharge lamps, in the prior art, were normally triggered by a single high voltage pulse at the peak of an open circuit ballast waveform. Disadvantageously, however, a single high voltage pulse, typically one microsecond wide, would, in some cases, not be sufficient to initiate a glow discharge to start a high intensity discharge lamp.

SUMMARY OF THE INVENTION

Another object of this invention is to provide for a new and improved starting aid for high-intensity discharge (HID) lamps in which lamp startability is enhanced.

Still another object of this invention is to provide for a multipulse trigger voltage with controlled number and separation of individual pulses to be generated in order to match the starting characteristics of a particular lamp type for enhanced startability.

The prior art does not teach multipulse generation to facilitate the startability of hard-to-start, high-intensity discharge lamps. However, if instead of a single pulse, a series of pulses is generated at the peak of the open circuit waveform, lamp startability is enhanced. The number of pulses can be optimized to match starting characteristics of a particular type of lamp.

In accordance with one aspect of the invention, a multipulse starting aid for a high-intensity discharge lamp having a pair of terminals includes a spiral line having a pair of conducting tapes wrapped in a spiral formation. The pair of tapes are physically separated from each other to form a capacitor having a capacitance C. Each tape has a pair of ends. A bi-directional solid-state switch is coupled at a point to one of the ends of one of the tapes. Means are provided for coupling the other of the ends of the one of the tapes to one of the lamp terminals. Resistive means having a resistance R are coupled from the bi-directional switch, at a junction, to the other of the terminals. Means are provided for coupling the junction to one of the ends of the other of the tapes. Means are provided for receiving an alternating current voltage source having a frequency F. A first inductive means is coupled across the receiving means. The alternating current voltage source receiving means and the first inductive means are commonly coupled to the other of the lamp terminals. A second inductive means is coupled between the receiving means and the aforesaid point, whereby, during starting the first inductive means and the second inductive means act as an autotransformer, and, during operation of the lamp, the second inductive means acts as a ballast. The time constant RC is so adjusted that, upon receiving the alternating current voltage source, a waveform of voltage at the frequency F is presented across the pair of terminals of the lamp, together with a series of pulses at the peak of each half-cycle of the waveform, which are necessary for the lamp initial breakdown. In accordance with certain features of the invention, the time constant RC is adjustable by varying the resistance R. The resulting series of pulses is an integer greater than one thereby enhancing lamp startability. The series can be an integer greater than one but less than nine. The series can be, for example, seven.

In accordance with another embodiment of the invention, a multipulse starting aid for a high-intensity discharge lamp having a pair of terminals includes a spiral line having a pair of conducting tapes wrapped in a spiral formation. The pair of tapes are physically separated from each other, forming a capacitor having a capacitance C. Each of the lines have a pair of ends. A spark gap is coupled at a point to one of the ends of one of the lines. Means are provided for coupling the other of the ends of that one of the lines to one of the terminals. Resistive means having a resistance R are coupled from the spark gap, at a junction, to the other terminal. Means are provided for coupling the junction to one of the ends of the other of the tapes. Means are provided for receiving an alternating current voltage source having a frequency F. First inductive means are coupled across the receiving means. The alternating current voltage source receiving means and the first inductive means are commonly coupled to the other of the lamp terminals. Second inductive means are coupled between the receiving means, and the latter said point whereby, during starting, the first inductive means and the second inductive means act as an autotransformer, and, during operation of the lamp, the second inductive means acts as a ballast. Thus, a time constant RC is so adjustable that, upon receiving the alternating current voltage source, a waveform of voltage at the frequency F is presented across the pair of terminals of the lamp, together with the series of pulses at the peak of each half-cycle of the waveform necessary for initial lamp breakdown. In accordance with certain features of the invention, the time constant RC is adjusted by varying the resistance R. The resulting series of pulses can be an integer greater than one thereby enhancing lamp startability. It can be an integer greater than one but less than nine. The series can be seven.

BRIEF DESCRIPTION OF THE DRAWINGS

Other objects, advantages, and features of this invention, together with its construction and mode of operation, will become more apparent from the following description, when read in conjunction with the accompanying drawing, in which.

DESCRIPTION OF PREFERRED EMBODIMENTS

Figure 1:
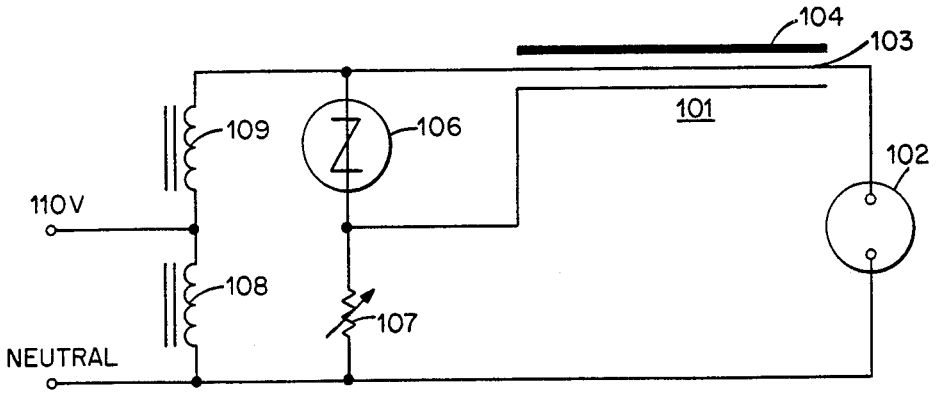
FIG. 1 is a schematic diagram of one embodiment of this invention.
Figure 2:
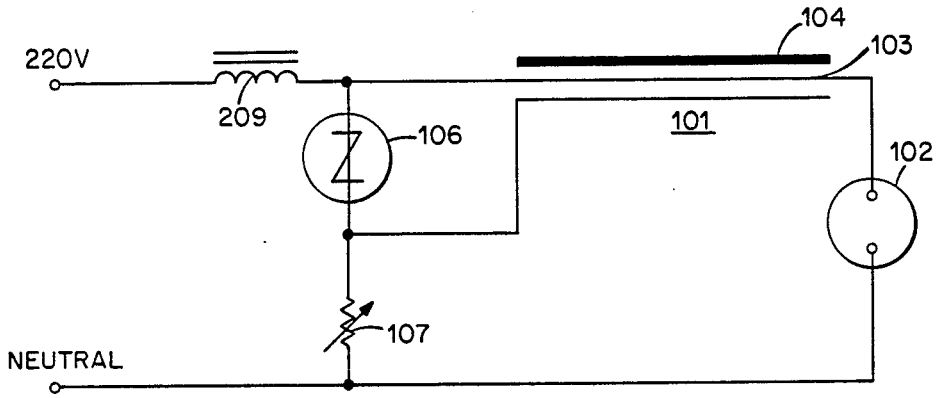
FIG. 2 is a schematic diagram of another embodiment of this invention.

Referring to FIG. 1, there is shown a schematic of a spiral line circuit 101 with a variable RC time constant to optimize the number of pulses for the best startability of a particular type of HID lamp 102. A spiral line 103 is used to generate pulses of high amplitude. In order to increase pulse amplitude and width, a spiral line 103 may be used in conjunction with a ferrite core 104. The high amplitude, for example, can be between three to five kilovolts; the increased width can be in excess of one microsecond. One or two 110-volt (or one 240 volt) sidacs 106 are used as a switch to initiate a travelling pulse in the spiral line 103. A spark gap, however, can be used instead of sidacs.

In FIG. 1, an inductor 108 is coupled across the 110 volt input line and the neutral line. Another inductor 109, coupled to the 110 volt input line, is connected to the sidac 106 and the spiral line circuit 101. During starting, the inductors 108, 109 act as an autotransformer. During operation of the lamp 102, the inductor 109 acts as a ballast.

A variable resistor 107, which in this example ranges from 3 to 20 kilohms, determines the required number of pulses through variance of the RC constant of the spiral line charging circuit.

Voltage waveforms were applied to a 100 watt metalarc lamp during the starting procedure, with single and seven spiral line spikes superimposed on the ac ballast waveform, respectively. It was noted that improved starting (shorter lag time between voltage application and the arc discharge) with seven pulses was clearly demonstrated. For simplicity of description, these waveforms are not depicted herein.

The theory and operation of the spiral line is well known to the art, and it is described in U.S. Pat. No. 4,325,004, supra. The spiral line acts as both a capacitor and a voltage multiplier. As a capacitor, its charging time is a function of the value of the resistor 107 which may be varied over an order of magnitude without change in the output pulse voltage. Depending on the RC time constant of the resistor 107 and the capacitor 101, up to 15 pulses have been generated by the spiral line used in this example. These high voltage pulses are superimposed on the peak of a ballast waveform. The starting aid herein described with multiple pulses (five to ten) reproducibly starts one-hundred watt lamps which are difficult to ignite with commercial starters.

The spiral line generator circuit 101 with variable resistance 107 or capacitance is constructed in order to change the RC time constant, and, consequently, the number of pulses produced by the spiral line starter 103. It was found that an RC circuit with variable resistance works much more reliably than a variable capacitance. The spark gap in place of the sidac can be used in this circuit although its lifetime may not be as good.

Figure 3A:
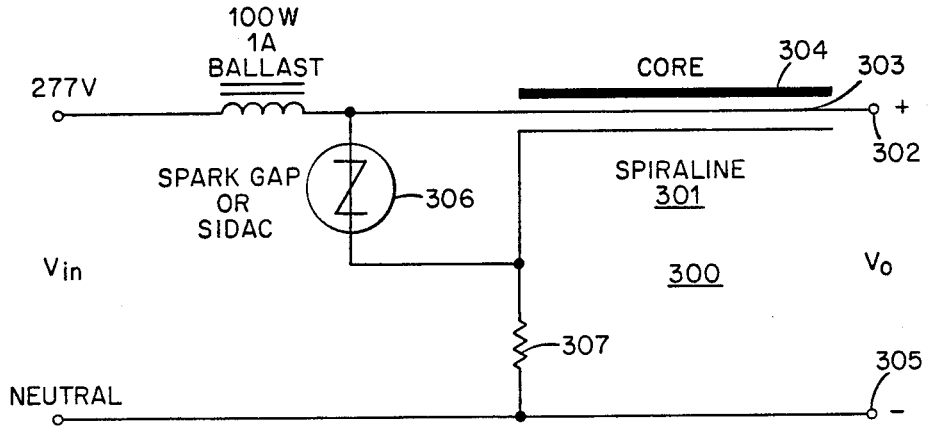
FIG. 3A is a circuit diagram of a multiple pulse generator useful for understanding this invention.
Figure 3B:
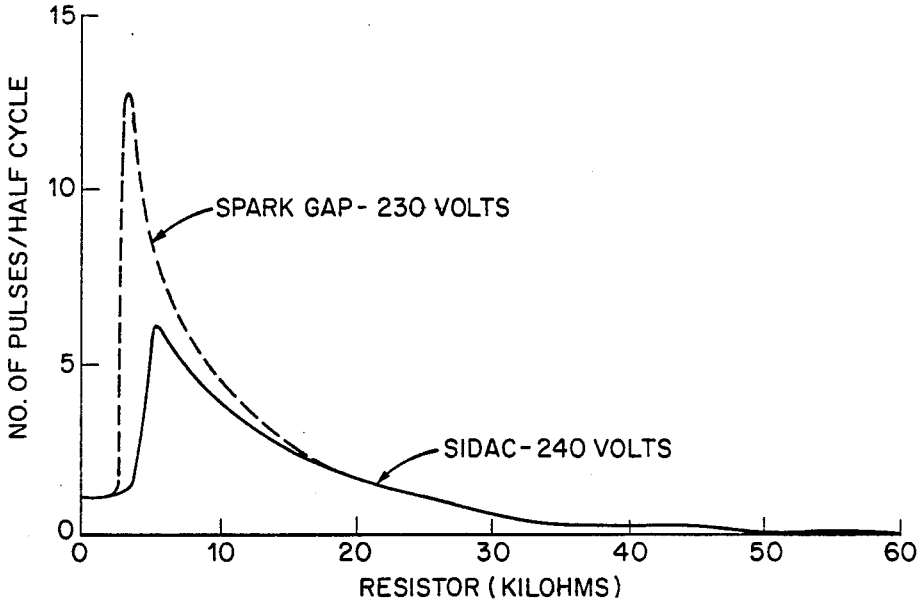
FIG. 3B is a diagram indicating an example of the relationship of number of pulses per half cycle versus resistance for the circuit depicted in FIG. 3A, the solid line indicating a 240 volt sidac, the dashed line indicating a 230 volt spark gap.
Figure 3C:
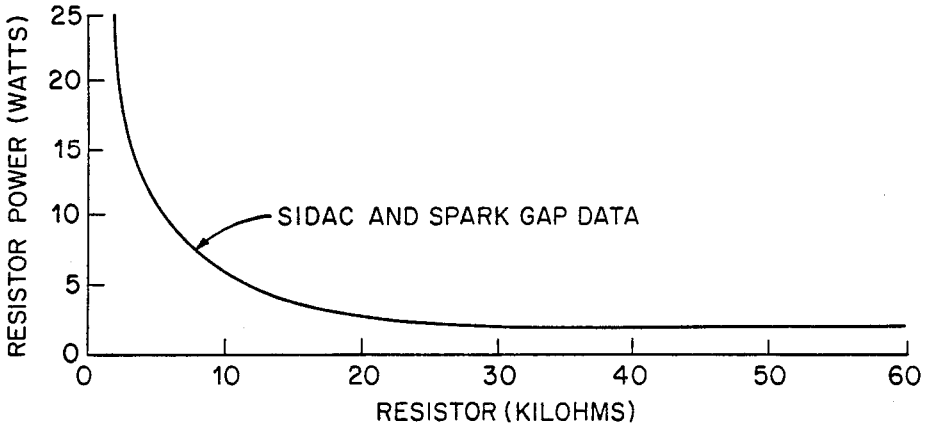
FIG. 3C is a diagram showing the required resistor power versus its resistance for the circuit shown in FIG. 3A, utilizing either sidac or spark gap data.

FIGS. 3B and 3C are a set of curves showing the number of output pulses versus resistance and resistors' wattage consumption versus resistance. The test was run using the circuit shown in FIG. 3A with a 240 volt sidac and a 230 volt spark gap. The spark gap has a higher holding current than the sidac; therefore, a circuit using a spark gap can be made to generate more pulses each half cycle. The holding current of the switching device having the source breakdown voltage is the limiting factor governing the maximum number of output pulses. The higher the holding current, the higher the upper pulse limit. The holding current of a 240 volt sidac is about 25 milliamperes, while the 230 volt spark gap extinguishes below 125 milliamperes.

The circuit output voltage with the sidac, in this example, was 6560 volts peak and with the spark gap was 9200 volts peak. This difference relates to faster turn-on of the spark gap than the turn-on time of the sidac. The value of resistance R had very little effect on the peak pulse voltage.

In FIG. 3A, there is shown a circuit 300 including a spiral line circuit 301 having an output 303 coupled to a positive output terminal 302. A ferrite core 304 is associated with the spiral line 303. A bidirectional solid state switch, such as a sidac, or a spark gap 306 is in series with a resistance 307 across the input of the spiral line 303 and a neutral output terminal 305. The junction of the elements 306, 307 is coupled to the spiral line circuitry 301. A 100 watt, one ampere ballast 309, coupled to the spiral line 303 and the spark gap or sidac 306, receives 277 volts from the applied voltage $V_{in}$. The input neutral is coupled to the output line 305.

Note from FIG. 3B, that by utilizing a sidac 306 in the circuit of FIG. 3A, a maximum of seven pulses are produced every half cycle when the resistor 307 has a value of about 7 kilohms. A maximum of 13 pulses can be produced each half cycle utilizing a spark gap in the circuit of FIG. 3A when the resistor 307 has a value of approximately 5 kilohms.

Both devices can use the same resistor for about the same number of pulses and power.

Figure 4:
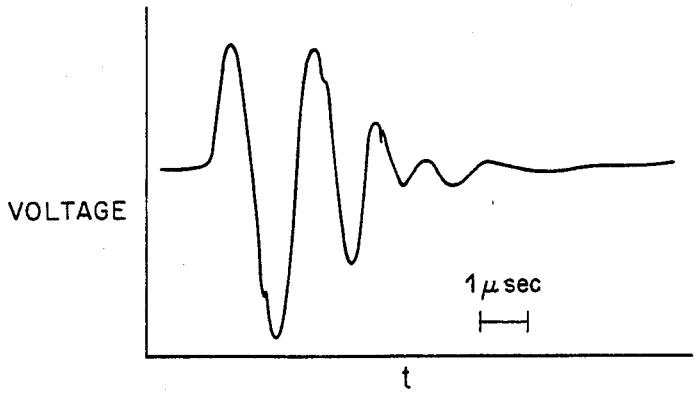
FIG. 4 depicts a typical shape of an open circuit individual voltage pulse (on a greatly expanded time scale)
Figure 5:
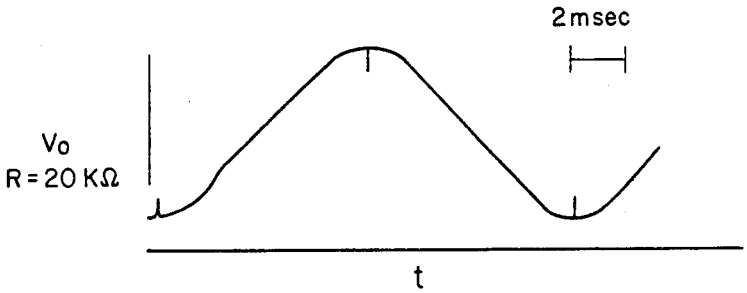
PRIOR ART Fig. 5.
FIG. 5 shows an alternating current waveform of a typical HID ballast with a single spiral line spike superimposed thereon (due to the substantially compressed time scale only the position of the high-voltage pulse is shown the peaks are not seen)
Figure 6A:
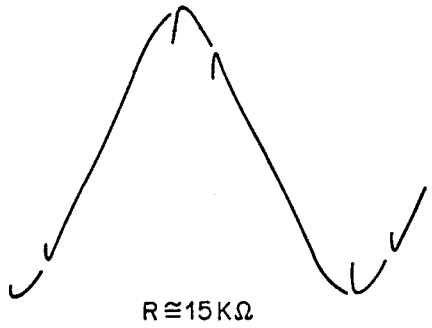
FIGS. 6A, 6B, 6C, and 6D show the ac waveforms for a typical HID ballast with two, four, six, and eight spiral line pulses superimposed thereupon, respectively (again, only the position of the high-voltage pulses are shown, the peaks are not seen), the pulses being placed close to the maximum of each one-half cycle.
Figure 6B:
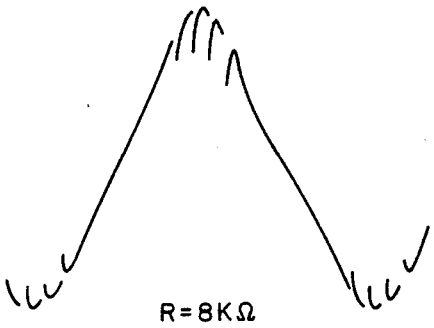
Figure 6C:
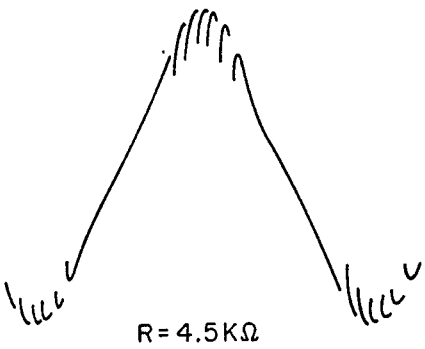
Figure 6D:
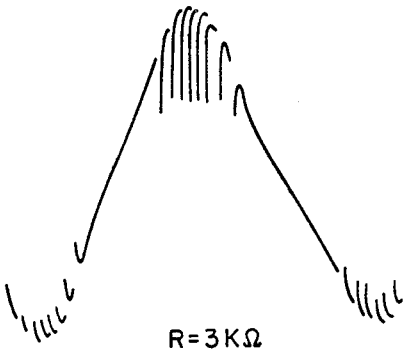

The individual pulse from the spiral line 103 in the circuit of FIG. 1 is shown in FIG. 4. FIGS. 5, 6A, 6B, 6C, and 6D show one alternating current cycle with one, two, four, six, and eight pulses, respectively, placed close to the maximum of each one-half cycle.

The lamp starting ability depends on the number of pulses forming breakdown and the maintenance of plasma conductivity. The optimum number of pulses depends on the particular lamp as well as the individual pulse amplitude and width.

Advantages of this invention include the following:

1. Multiple high-voltage pulses which occur near the peak of the line voltage enhance lamp starting.

2. The circuit is inexpensive.

3. The circuit generates multiple output pulses whose number varies with the choice of ballast resistance, switch breakover voltage, and spiral line capacitance. The upper limit on the number of pulses is effected mainly by the holding current of the switching device.

4. The switching device is not latched on at resistances above the minimum value so that the starter resistor is not placed in parallel with the lamp during lamp breakdown. This, along with the multiple pulse feature, enhances lamp glow to arc transition, which lengthens lamp life.

5. The starter draws low power and low current due to the selection of resistance over a limited range.

6. Using a minimum amount of resistance, the switching device does not latch on and cause the starter to draw high current and power. Multiple output pulses are not possible after the switching device latches on.

7. The circuit works with either a spark gap or a sidac whose breakdown voltage is greater than the lamp peak operating voltage.

Various modifications can be performed with this invention without departing from the spirit and scope thereof.

What is claimed is:

1. A multipulse starting aid for a high intensity discharge lamp having a pair of terminals comprising a spiral line having a pair of lines wrapped in a spiral formation, said pair of lines being physically separated from each other forming a capacitor having a capacitance C, each of said lines having a pair of ends;

a biddirectional solid state switch coupled at a point to one of said ends of one of said lines;

means for coupling the other of said ends of said one of said lines to one of said terminals;

resistive means, having a resistance R, for coupling from said bidirectional switch at a junction to the other of said terminals;

means for coupling said junction to said one of said ends of the other of said lines;

means for receiving an alternating current voltage source having a frequency F;

first inductive means coupled across said receiving means;

means for coupling said receiving means and said first inductive means to said other of said terminals;

second inductive means coupled between said receiving means and said point, whereby, during starting, said first inductive means and said second inductive means act as an autotransformer, and during operation of said lamp, said second inductive means acts as a ballast;

whereby the time constant RC is so adjusted that, upon receiving said alternating current voltage source, a waveform of voltage at said frequency F is presented across said pair of terminals of said lamp, together with a series of pulses at the peak of each half cycle of said waveform, thereby enhancing lamp startability.

2. The multipulse starting aid as recited in claim 1 wherein said time constant RC is adjusted by varying said resistance R.

3. The multipulse starting aid as recited in claim 1 wherein said series is an integer greater than one.

4. The multipulse starting aid as recited in claim 1 wherein said series is an integer greater than one, but less than nine.

5. The multipulse starting aid as recited in claim 1 wherein said series is seven.

6. A multipulse starting aid for a high intensity discharge lamp having a pair of terminals comprising a spiral line having a pair of lines wrapped in a spiral formation, said pair of lines being physically separated from each other forming a capacitor having a capacitance C, each of said lines having a pair of ends;

a spark gap coupled at a point to one of said ends of one of said lines;

means for coupling the other of said ends of said one of said lines to one of said terminals;

resistive means, having a resistance R, for coupling from said gap at a junction to the other of said terminals;

means for coupling said junction to said one of said ends of the other of said lines;

means for receiving an alternating current voltage source having a frequency F;

first inductive means coupled across said receiving means;

means for coupling said receiving means and said first inductive means to said other of said terminals;

second inductive means coupled between said receiving means and said point, whereby during starting, said first inductive means and said second inductive means act as an autotransformer, and during operation of said lamp, said second inductive means acts as a ballast;

whereby the time constant RC is so adjusted that, upon receiving said alternating current voltage source, a waveform of voltage at said frequency F is presented across said pair of terminals of said lamp, together with a series of pulses at the peak of said half cycle of said waveform, thereby enhancing lamp startability.

7. The multipulse starting aid as recited in claim 6 wherein said time constant RC is adjusted by varying said resistance R.

8. The multipulse starting aid as recited in claim 6 wherein said series is an integer greater than one.

9. The multipulse starting aid as recited in claim 6 wherein said series is an integer greater than one, but less than nine.

10. The multipulse starting aid as recited in claim 6 wherein said series is seven.

* * * * *